United States Patent [19]

Selmer

[11] Patent Number: 4,825,742

[45] Date of Patent: May 2, 1989

[54] DETACHABLE FLUIDTIGHT ASSEMBLY SYSTEM FOR TWO INTERENGAGING ELEMENTS OF THE ACOUSTIC TUBE OF A MUSICAL WIND INSTRUMENT

[75] Inventor: Jean Selmer, Paris, France

[73] Assignee: Societe Anonyme dite: Henri Selmer & Cie, Paris, France

[21] Appl. No.: 27,006

[22] Filed: Mar. 17, 1987

[30] Foreign Application Priority Data

Mar. 19, 1986 [FR] France ..... 86 03913

[51] Int. Cl.[4] ..... G10D 9/00

[52] U.S. Cl. ..... 84/380 R; 84/385 R; 84/387

[58] Field of Search ..... 84/386–401

[56] References Cited

U.S. PATENT DOCUMENTS 1,575,257 3/1926 Earl ..... 84/382 R 2,059,450 11/1936 Frank ..... 84/388

2,061,928 11/1936 Albrecht ..... 84/384 R

FOREIGN PATENT DOCUMENTS 632799 12/1949 United Kingdom ..... 84/385 R

*Primary Examiner*—Lawrence R. Franklin

*Attorney, Agent, or Firm*—Scully, Scott, Murphy & Presser

[57] ABSTRACT

A system for the detachable fluidtight assembly of two interengaging elements of the acoustic tube of a wind instrument. The system comprises two half-collars which at one end are connected together in the assembled position by a connection means, while at their other end they are detachably connected together by at least one screw or the like, said half-collars gripping around the interengaged parts of said acoustic tube elements with the interposition of at least one seal between said half-collars and at least one of said elements.

8 Claims, 3 Drawing Sheets

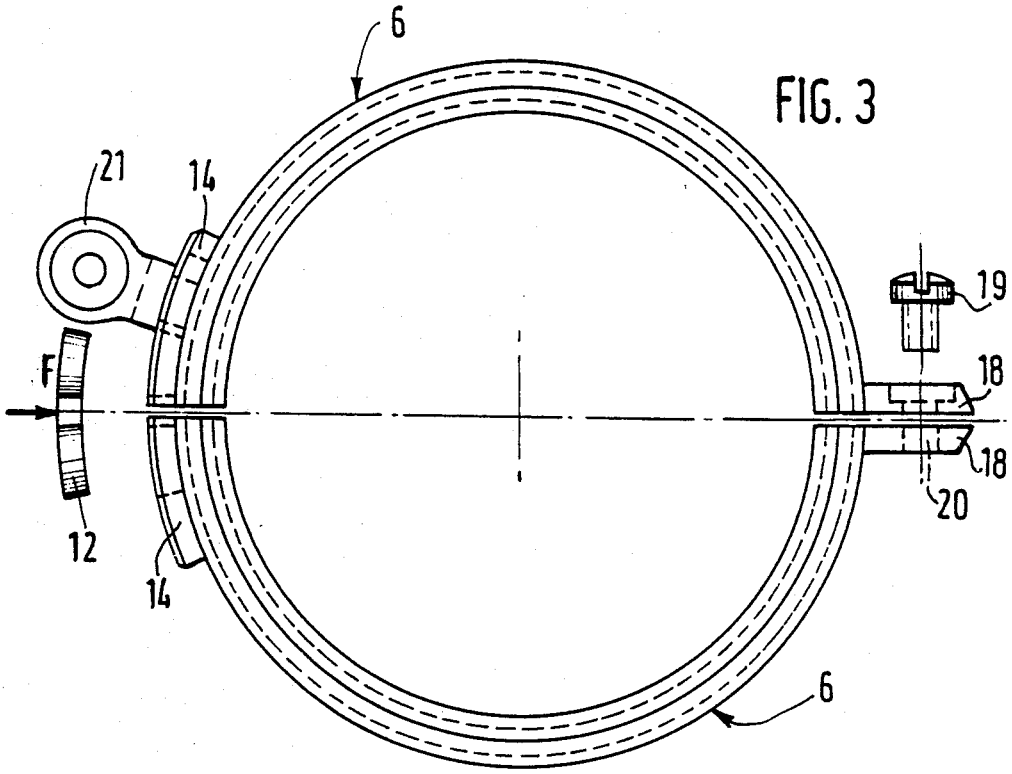
FIG. 3
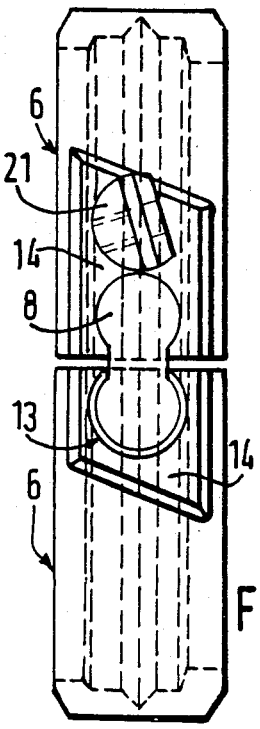
FIG.4
FIG.5
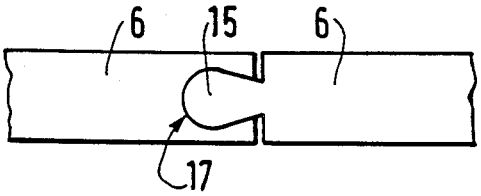

DETACHABLE FLUIDTIGHT ASSEMBLY SYSTEM FOR TWO INTERENGAGING ELEMENTS OF THE ACOUSTIC TUBE OF A MUSICAL WIND INSTRUMENT

The present invention relates to a system for the detachable fluidtight assembly of two elements of the acoustic tube of a musical wind instrument.

It is known that numerous wind instruments are composed of a plurality of elements, which are generally fitted together by simple interengagement, thus enabling the player to carry them in dismounted form in a small case and to assemble them at the place where they are to be played.

In the case of certain instruments, however, the elements of the acoustic tube are preassembled in their carrying case; this applies in particular to alto, tenor or baritone saxophones, to which the player has simply to fit the mouthpiece before use.

These saxophones were at one time sold in one-piece form, with the different elements (body, base and bell) soldered together.

In order to facilitate the polishing of these instruments and their repair when necessary, they are still at the present time supplied to users in one-piece form, but the various preassembled elements can be detached, systems of collars generally being used to join them together.

Apart from the fact that their appearance is not attractive, these collars also have the disadvantage of not ensuring fluidtight connection of the acoustic tube elements, which is detrimental to the acoustic response of the instrument.

The present invention seeks to overcome this serious disadvantage by proposing a new assembly system for the elements of a wind instrument, this system always allowing easy disconnection of these elements but ensuring perfect fluidtightness of their connection in the position of use of the instrument.

To this end the invention relates to a system for the detachable fluidtight assembly of two interengageable elements of the acoustic tube of a wind instrument, characterized in that it comprises two half-collars which at one end are connected together in the assembled position by a connection means, while at their other end they are detachably connected together by a least one screw or the like, these half-collars gripping around the interengaged parts of said acoustic tube elements with the interposition of at least one seal between the half-collars and at least one of said elements.

The half-collars preferably bear by means of parts of appropriate shapes against projecting parts of the acoustic tube elements which are to be assembled, for example against a portion inclined in relation to the axis on one of them and against an annular boss on the other element, while the seal will be disposed in an annular groove in the half-collars, in such a manner that when the two half-collars are joined together with the aid of said screw or screws, not only will the seal be compressed but at the same time said acoustic tube elements will be brought closer to one another.

Said seal will advantageously be applied against the outer face of the acoustic tube element provided with the annular boss, and will be gripped between said boss and the end part of the other element, this end part being disposed obliquely relative to said outer face, that is to say bell-mouthed at its end. This bell-mouthed end portion and the seal will be received in the groove in the half-collars, said groove having a suitable profile, for example a V-shaped profile in section in an axial plane, with the V opening in the direction of the axis.

The connecting element between the two half-collars may be a hinge arrangement. It could also be a member forming a key and received in appropriately shaped cavities in the half-collars; this member could be detachable or fastened to one of the half-collars.

A system of this kind for the assembly of the body and the base of a saxophone ensures perfect fluidtightness at their junction, and will participate in the acoustic properties of the instrument without impairing its external appearance, while being very easily detachable in case of need. The invention is obviously not restricted to saxophones, but is applicable to other wind instruments, for example bassoons.

Various embodiments of the invention will be described below with reference to the accompanying drawings, in which:

FIG. 3 is a partly exploded end view of the assembly system;

FIG. 4 is a partial view in the direction of the arrow F in FIG. 3;

FIG. 5 is a partial diagram showing a variant of the member connecting together the two half-collars.

Figure 1:
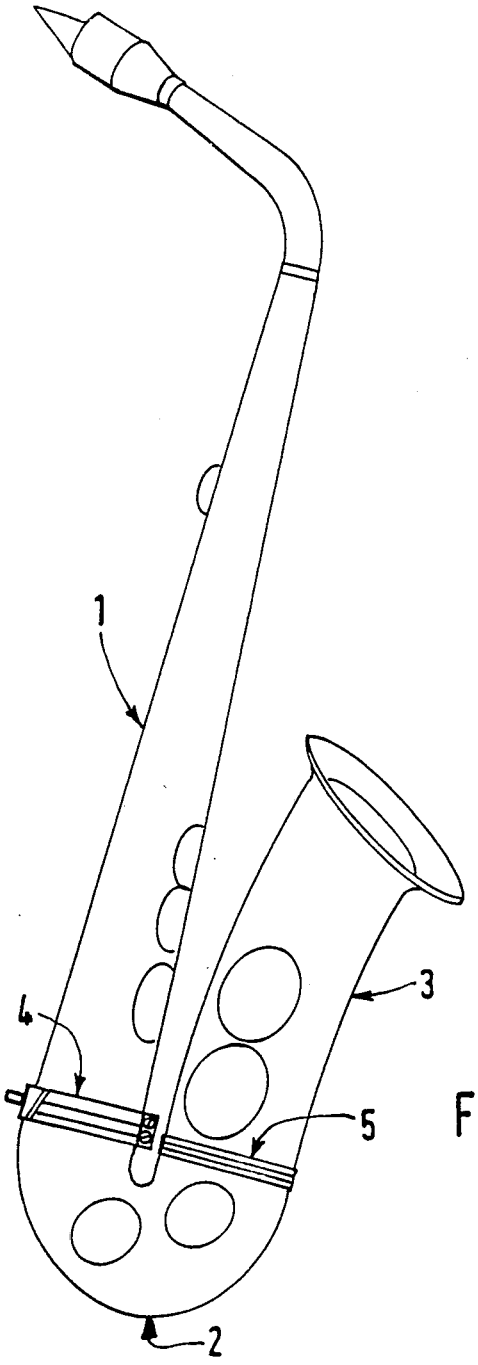
FIG. 1 is a diagram of a saxophone illustrating the connection of the body and the base by means of the assembly system according to the invention.

As illustrated in FIG. 1, the acoustic tube of a saxophone comprises a body 1, a base 2, and a bell 3, which are joined together by collars 4 and 5.

According to the invention the collar 4 is composed of two half-collars 6 of semicylindrical profile, which when fitted on the saxophone bear by means of appropriately shaped parts against a part 7 of the body 1, this part being disposed obliquely in relation to its axis, and against an annular boss 8 forming a bead on the base 2. An O-ring seal 10 is gripped between the bead 8 and the bell-mouthed end 9 of the body 1, and is received, together with the bell-mouthed end 9, in a groove 11 of V-shaped section in the half-collars.

Figure 2:
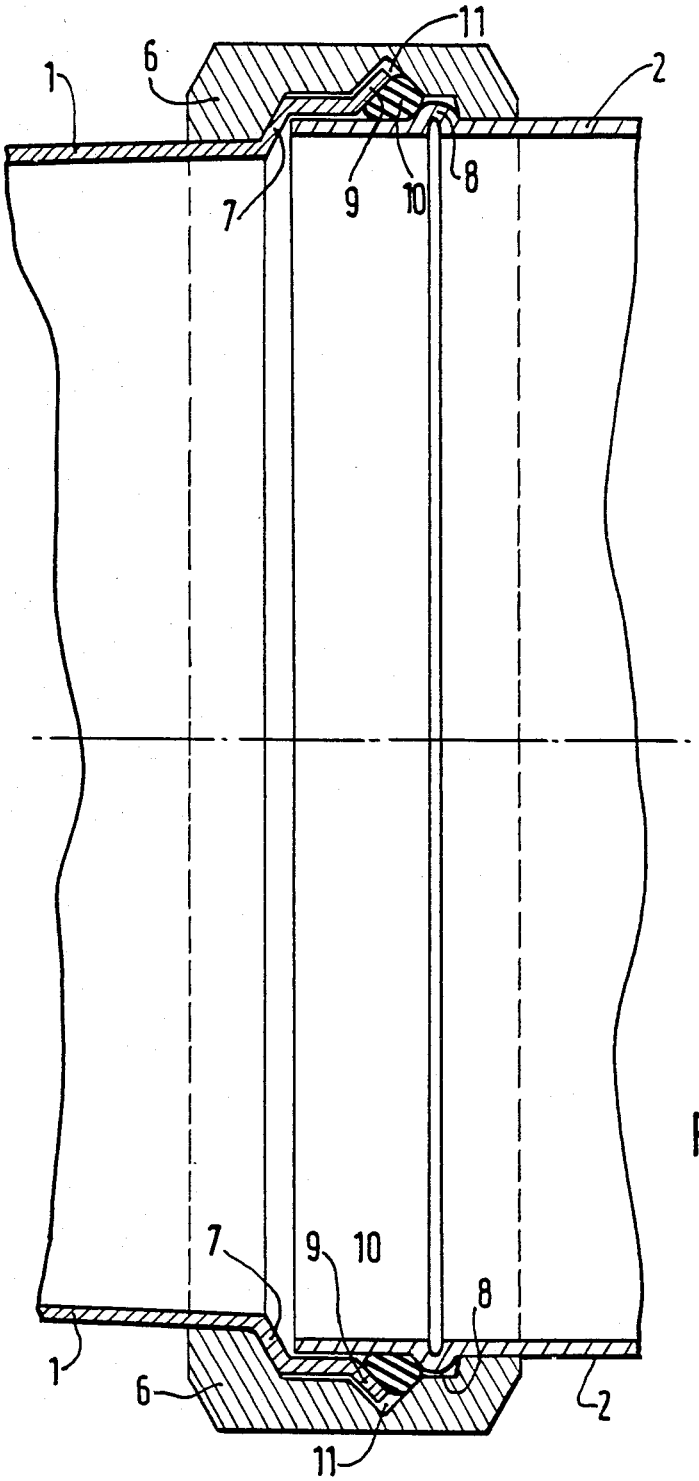
FIG. 2 is an axial section of these two acoustic tube elements in the assembled position.

The half-collars are joined together at one end by a connection member, which in the case of FIGS. 2 to 4 consists of a detachable key 12 having the shape of a figure of eight and received in cavities 13 of complementary profile, which are provided in shoes 14 fixed on the half-collars 6.

In the variant shown in FIG. 5 the key 15 is integral with one of the half-collars 6 and is engaged in a cavity 17 in the other half-collar.

The half-collars may also be articulated to one another at one end by means of hinges.

At their other end the half-collars 6 each have a plane projecting part 18, these parts being adapted to bear against one another in an axial plane through the action of at least one screw 19 engaged in threaded cavities 20 in said parts 19.

When the half-collars 6 are brought close to one another by means of the screw or screws 19, the O-ring seal 10 is compressed against the bead 8 on the base, the bell-mouthed end portion 9 of the body 1, and the half-collars 6, in the groove 11 in which the seal is deformed, thus ensuring the fluidtightness of the connection. At the same time, when the half-collars 6 are brought close to one another, so that they bear against the inclined end part 7 of the body 1 and against the bead 8 on the base, this has the effect of bringing these two elements axially towards one another, while the seal 10 crushed between them exerts an antagonistic force and thus takes up any play existing in the axis of the parts.

The system according to the invention thus ensures perfect assembly of the elements 1 and 2, with excellent fluidtightness at their junction. Moreover, it provides easy disconnection in case of need. Finally, it does not in any way complicate the arrangement of the keys, pivots or other parts of the saxophone, and the half-collars may even carry certain parts, for example—as shown in the drawings—a guard lug 21 fastened on a shoe 14 and forming a support for a component of the instrument.

I claim:

1. A system for the detachable fluidtight assembly of two interengaging elements of the acoustic tube of a wind instrument, wherein two half-collars are provided which at one end are connected together in an assembled position by a connection means, while at their other end said half-collars are detachably connected together by at least one screw or the like, said half-collars gripping around the interengaged parts of said acoustic tube elements with the interposition of at least one seal between the half-collars and at least one of said elements, wherein said half-collars bear by means of parts of appropriate shape against projecting parts of said acoustic tube elements, said projecting parts being disposed in such a manner that when said half-collars are brought close to one another they move said elements axially in the direction of one another, and in which said seal is received in an annular groove in said half-collars.

2. An assembly system as claimed in claim 1, in which said connection element for said half-collars comprises a hinge arrangement.

3. An assembly system as claimed in claim 1, in which said projecting parts of said elements of the acoustic tube comprise a part, inclined in relation to its axis, on one of said elements and an annular boss forming a bead on the other element.

4. An assembly system as claimed in claim 3, in which said seal is applied by said half-collars against the outer face of the acoustic tube element provided with said annular boss and is gripped between said boss and the bell-mouthed end part of the other element.

5. An assembly system as claimed in claim 4, in which said bell-mouthed end part is received together with said seal in said groove in said half-collars.

6. An assembly system as claimed in one of claims 3 to 5, in which said groove has, in section through an axial plane, a V-shaped profile opening in the direction of the axis.

7. An assembly system as claimed in claim 1, in which said connection element for said half-collars is a detachable element forming a key received in cavities of complementary profile in said half-collars.

8. An assembly system as claimed in claim 1 in which said connection element for said half-collars is an element forming a key rigidly fastened to one of said half-collars and engaged in a cavity of complementary profile in the other half-collar.

* * * * *